US005245974A

United States Patent [19]

Watson et al.

[11] Patent Number: 5,245,974

[45] Date of Patent: Sep. 21, 1993

[54] TREATMENT OF FUEL VAPOR EMISSIONS

[75] Inventors: Stephen J. Watson, Churchlands; Darren A. Smith, Doubleview; Stuart A. Higgins, Embleton; Christopher N. F. Sayer, Ferndale, all of Australia

[73] Assignee: Orbital Engine Company (Australia) Pty. Limited, Western Australia, Australia

[21] Appl. No.: 923,781

[22] PCT Filed: Feb. 27, 1991

[86] PCT No.: PCT/AU91/00065

§ 371 Date: Aug. 26, 1992

§ 102(e) Date: Aug. 26, 1992

[87] PCT Pub. No.: WO91/13251

PCT Pub. Date: Sep. 5, 1991

[30] Foreign Application Priority Data

Feb. 27, 1990 [AU] Australia ..... PJ8829

[51] Int. Cl.[5] ..... F02M 33/02; F02M 23/00

[52] U.S. Cl. ..... 123/518; 123/533

[58] Field of Search ..... 123/531, 533, 516, 518, 123/519, 520, 521

[56] References Cited

U.S. PATENT DOCUMENTS

| | | | |
|---|---|---|---|
| 4,376,423 | 3/1983 | Knapstein | 123/533 |
| 4,519,356 | 5/1985 | Sarich | 123/533 |
| 4,530,210 | 7/1985 | Yamazaki | 60/605 |
| 4,794,902 | 1/1989 | McKay | 123/533 |
| 4,841,942 | 6/1989 | McKay | 123/533 |
| 4,962,745 | 10/1990 | Ohno et al. | 123/533 |
| 5,005,550 | 4/1991 | Bugin, Jr. et al. | 123/520 |
| 5,024,202 | 6/1991 | McKay | 123/533 |
| 5,054,454 | 10/1991 | Hamburg | 123/533 |
| 5,138,023 | 2/1993 | Hanson | 123/519 |
| 5,190,015 | 3/1993 | Nakata et al. | 123/520 |

OTHER PUBLICATIONS

Patent Abstracts of Japan, M-245, p. 35, JP,A, 58-110852 Jul. 1983.

*Primary Examiner*—E. Rollins Cross
*Assistant Examiner*—Thomas Moulis
*Attorney, Agent, or Firm*—Nikaido, Marmelstein, Murray & Oram

[57] ABSTRACT

An internal combustion engine installation is provided which comprises an air compressor (20) to supply air to effect injection of the fuel for combustion in the engine, a fuel tank (12), an air/fuel separator (10) to receive vapor generated in the fuel tank (12) and separate the fuel in vapor from the air and a passage (25) communicating the separator with the inlet port of the compressor (20) so that when the compressor (20) is in operation at least part of the air taken in by the compressor (20) is drawn through the part of the separator (10) where the fuel is held to extract fuel therefrom.

15 Claims, 3 Drawing Sheets

TREATMENT OF FUEL VAPOR EMISSIONS

This invention relates to the treatment of fuel vapours generated in a fuel tank that provides fuel for an internal combustion engine.

In many countries, regulations relating to emissions from vehicles require the treatment of the vapours generated in the fuel tank to eliminate or substantially reduce the amount of fuel released to the atmosphere by such vapours. It is known that in operating a vehicle the fuel tank can reach temperatures in the order of between 30° C. and 55° C., and accordingly there is significant fuel vapour generated in the fuel tank which would be harmful if released in an untreated manner to atmosphere.

Accordingly, most regulations controlling emissions from vehicles require a suitable form of separator to be provided so that vapours escaping from the fuel tank pass through the separator to remove the fuel therein before the air is released to atmosphere. Usually the separator is of the activated carbon type commonly referred to as the "carbon canister". Such separators operate on the principle of physical adsorption of fuel vapours onto the activated carbon.

Whilst the engine is operating, the air released from the separator is directed to the engine air intake system and accordingly any fuel that may not have been removed in the separator is directed into the engine and is therefore not released to atmosphere. However, when the engine is not operating, particularly immediately after the engine is stopped and the fuel tank temperature is high, the generation of fuel vapour continues and the pressure is sufficient to discharge the vapour into the separator. There is thus an accumulation of fuel in the separator over a significant period of time after the engine has been switched off.

Normally, the separator is designed to have sufficient capacity to retain all the fuel that passes to the separator from the fuel tank after engine shut down, however, this may result in the filter media being loaded with fuel at the time of next start-up of the engine. This fuel in the filter media is drawn into the engine air intake system and can cause the engine on start up to have an oversupply of fuel and hence may produce a high level of hydrocarbon emissions in the exhaust gas. Also this excess fuel supply can cause the engine to run at a speed considerably greater than that as determined by the throttle position and the fuel metering system. This form of operation of the engine after start up is not commercially or environmentally acceptable.

One proposal to deal with this problem is to provide in the vapour control systems a solenoid operated valve that is operated during start-up, so the separator is isolated from the air induction system.

It is the object of the present invention to provide in conjunction with an internal combustion engine a system whereby the fuel accumulated in the separator during engine shut down is disposed of without adverse effects on the operation of the engine.

With this object in view there is provided according to the present invention in an internal combustion engine installation, an air compressor to supply air to effect injection of the fuel for combustion in the engine, a fuel tank wherein fuel for use by the engine is stored, an air/fuel separator to receive vapour generated in the fuel tank and separate the fuel in the vapour from the air, a passage communicating that part of the separator wherein the fuel is held with the inlet port of the compressor so that when the compressor is in operation, at least part of the air taken in by the compressor is drawn through the part of the separator where the fuel is held to thereby extract fuel therefrom.

Conveniently, a check valve is provided between the fuel tank and the separator set so that the valve will remain closed if the pressure in the fuel tank is below a preset figure, for example, 7 kPa, for if the pressure in the fuel tank is too low, excessive fuel vaporisation occurs which would increase the fuel vapour load on the system. Further there is conveniently provided between the check valve and the fuel tank or in the fuel tank itself, a further valve that will open if the pressure in the fuel tank falls below atmospheric, thereby avoiding the risk of damage and possible rupture of the fuel tank due to sub-atmospheric pressure therein.

In fuel injection systems where air is used to deliver the fuel to the engine, it is customary to provide a pressure regulator upstream from the compressor so that the pressure of the air effecting delivery of the fuel can be maintained at a predetermined value, being a value below the normal delivery pressure of the compressor. The air released by the regulator is preferably redirected to the inlet port of the compressor.

By drawing air in a reverse flow through the separator into the compressor, fuel which has accumulated in the separator following a period of engine shut down is carried into the compressor and subsequently delivered through the fuel injector to the combustion chamber. The separator is thereby purged of the accumulated fuel without significantly changing the actual fuel/air ratio of the mixture in the combustion chamber. Accordingly, although the fuel purged from the separator by the compressor, per engine cycle and subsequently delivered to the engine as proposed by the present invention, the quantity of purged fuel is considerably less than the quantity of fuel which would be purged from the separator in the normal manner when calculated on a fuel quantity per engine cycle basis. Accordingly, purging of the fuel from the separator in accordance with the invention has a substantially reduced effect on the emission levels in the exhaust gas as compared with the prior used system, and also has no significant effect on the engine operating speed, as compared with the prior system. This advantage may be further enhanced by controlling the proportion of fuel passing to the compressor from the separator. This is most conveniently achieved by controlling the rate of flow of air passing through the separator to the compressor, thus directly controlling the proportion of fuel passing to the compressor. The control means is preferably arranged so that the air flow rate to the compressor is constant for any particular or narrow range of engine load at a particular speed.

Modern engine installations include a programmed fuel metering means arranged to determine the engine fuel demand in response to engine operating condition input signals. These input signals include an engine speed signal and the programme may be arranged to effect a predetermined correction to the engine fuel demand relative to the engine speed in compensation for the rate of fuel flow to the compressor from the separator.

The present invention may also be conveniently applied to engine installations provided with a fuel rail from which fuel and compressed air are individually distributed to a number of fuel injector units, as described in the applicants U.S. Pat. No. 4,934,329. In such installations, fuel is circulated through the rail and back to the fuel tank to prevent the formation of fuel vapour in the rail. As will be appreciated, heat is transferred to the fuel from the compressed air supplied to the rail and so an increased heat input is imposed upon the fuel tank relative to conventional engine installations. It follows that the vapour load to be handled in such installations is higher and that the separator therefore requires regular purging during engine operation.

The invention will be more readily understood from the following description of one practical arrangement of the fuel vapour treatment process for internal combustion engines incorporating the present invention, and as illustrated in the accompanying drawings.

Figure 1:
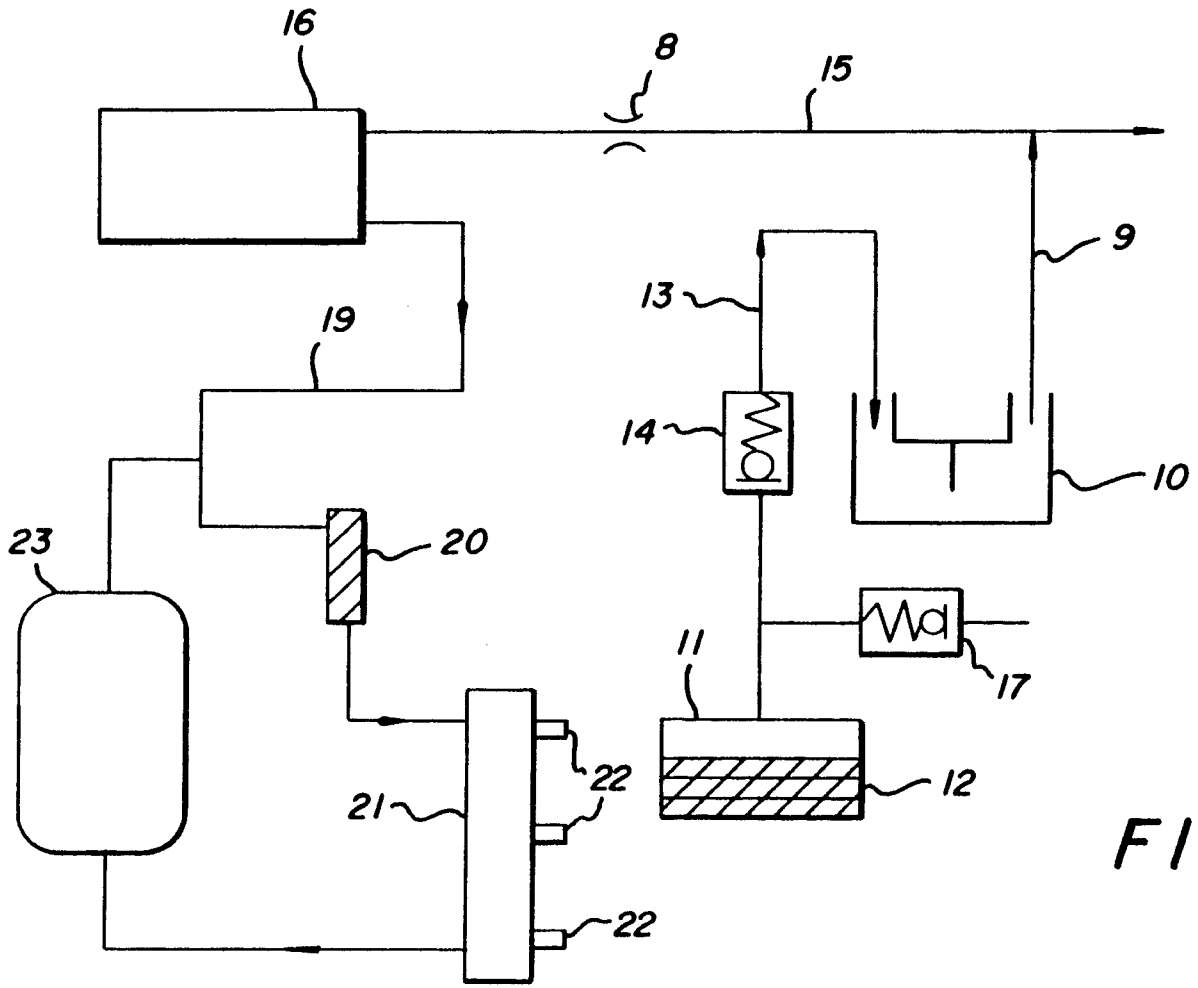
FIG. 1 is a diagrammatic layout of the vapour control and compressed air systems as currently practised.

Referring now to FIG. 1, the separator 10 is of a conventional construction having a filter medium of activated carbon and is conventionally referred to in the automotive industry as the carbon canister. The vapour space 11 in the fuel tank 12 communicates the conduit 13 to the input side of the separator 10. The check valve 14 located in the conduit 13 is set so as to open and permit a flow of vapour from the fuel tank 12 to the separator 10 when the pressure of the vapour in the fuel tank 12 is more than 10 kPa above the pressure in the separator 10. The check valve 17 communicates through the conduit 13 with the vapour space 11 in the fuel tank, and it is set to open if the pressure in the fuel tank 12 falls below atmospheric.

The outlet side of the separator 10 communicates via the conduit 9 with the air induction passage 15 of the engine downstream of the conventional air box 16 and throttle valve 8 through which the air is drawn into the air induction system of the engine when the engine is in operation. Thus when the engine is in operation and the pressure in the vapour space 11 in the fuel tank 12 is sufficiently high, vapour will pass from the fuel tank through the separator 10 where the fuel in the vapour will be absorbed by the activated carbon and the treated air will pass into the air induction passage 15. Whilst the engine is running, the air which enters the air induction passage 15 from the separator 10 will form part of the air carried into the engine through the air induction system, and when the engine is not operating, the air passing into the air passage 15 from the separator 10 will be released to atmosphere.

The compressor 20 draws air from the air box 16 through the conduit 19 and delivers compressed air into the air rail 21 from which air is supplied to the series of fuel injectors 22 to effect delivery of the fuel into the engine combustion chambers. The regulator 23 controls the pressure of the air in the air rail 21 and air released by the regulator 23 is returned to the conduit 19 on the intake side of the compressor 20.

Although the compressor draws its air supply from the air box 16 into which the cleaned air from the separator 10 is delivered, the proportion of air passing through the air box to the compressor 20 is small compared with the quantity of air passing through the air box 16 and passage 15 into the air induction system of the engine. Where there has been an accumulation of fuel in the separator 10, following shut down of the engine, on subsequent start up of the engine air will be drawn through the seprator into the in the air induction passage. All of the fuel drawn into the air induction passage 15 with air from the separator 10 will immediately enter the air induction system and be carried into the combustion chamber of the engine with no fuel passing through the conduit 19 to the compressor 20. As a result of the majority of this fuel from the separator 10 being carried directly into the air induction system, an over-rich fuel/air mixture is delivered to the engine and may lead to the generation of excessive contaminants in the exhaust gas and/or over-revving of the engine, as previously referred to.

Figure 2:
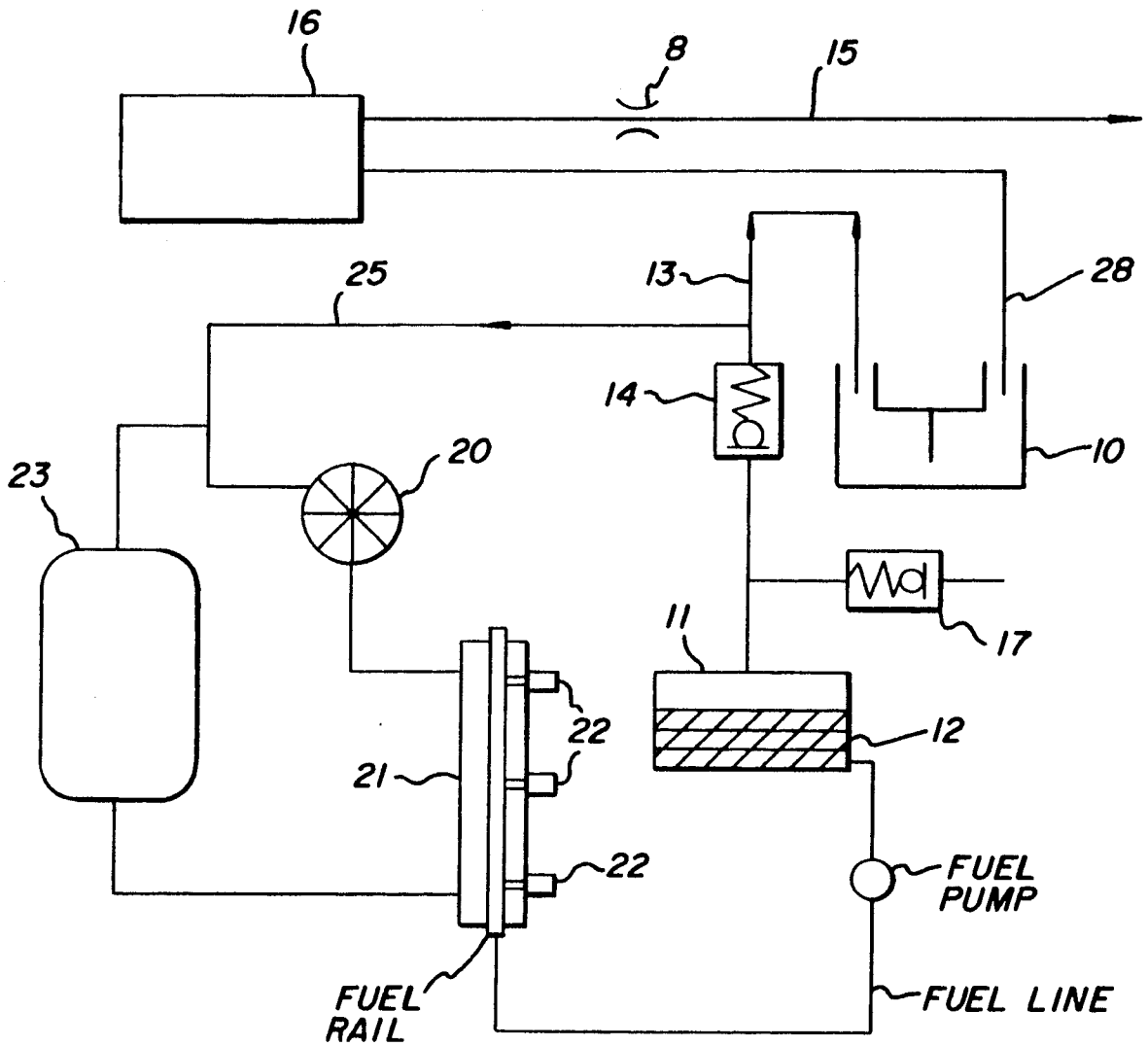
FIG. 2 is a diagrammatic layout of the vapour control and compressed air systems in accordance with one embodiment of the present invention.

The present invention proposes to modify the above described system by substituting the conduit 19 as shown in FIG. 1 by a conduit 25 as shown in FIG. 2, directly connected to the conduit 13 downstream of the check valve 14 and upstream of the separator 10. Fuel vapour discharged from the fuel tank 12 is thus drawn directly into the intake port of the compressor 20. Accordingly, when the engine is operating, the compressor will draw fuel vapour from the fuel tank 12 and additional air as required from the engine air box 16 through the conduit 28 and separator 10, the latter air being drawn in a reverse flow through the separator 10. In the situation where the vapour load from the fuel tank is greater than can be taken by the compressor 20, then the excess vapour will pass through the separator 10 in the conventional manner and be delivered through the conduit 28 into the air induction system of the engine.

One advantage of the vapour handling system as depicted in FIG. 2 is that after a period of shut down of the engine there will be an accumulation of fuel in the active carbon in the separator 10 as previously discussed, but on start up there will be a reverse flow of air from the air induction passage through the separator 10 to the compressor 20. This reverse flow will purge fuel from the active carbon in the separator 10 and that fuel will be subsequently delivered to the engine combustion chamber by the compressor 20, via the air rail 21 and the injectors 22. This reverse flow of air through the separator 10 prevents the excess fuel in the separator being drawn directly into the air induction system of the engine, but instead causes the fuel to be delivered to the combustion chamber of the engine through the injectors 22 at a substantially reduced rate so as to not significantly affect the performance of the engine or the level of emissions in the exhaust gas.

There is a further advantage in that the fuel from the separator is delivered by the fuel injectors 22 directly into the combustion chamber at a time in the engine cycle when the exhaust port thereof would be closed. Accordingly, short circuiting of that fuel out through the exhaust port in an unburnt condition is prevented, whereas if the fuel from the separator is delivered with the inducted air some raw fuel may escape through the open exhaust port. This is particularly so in two stroke cycle engines.

Figure 3:
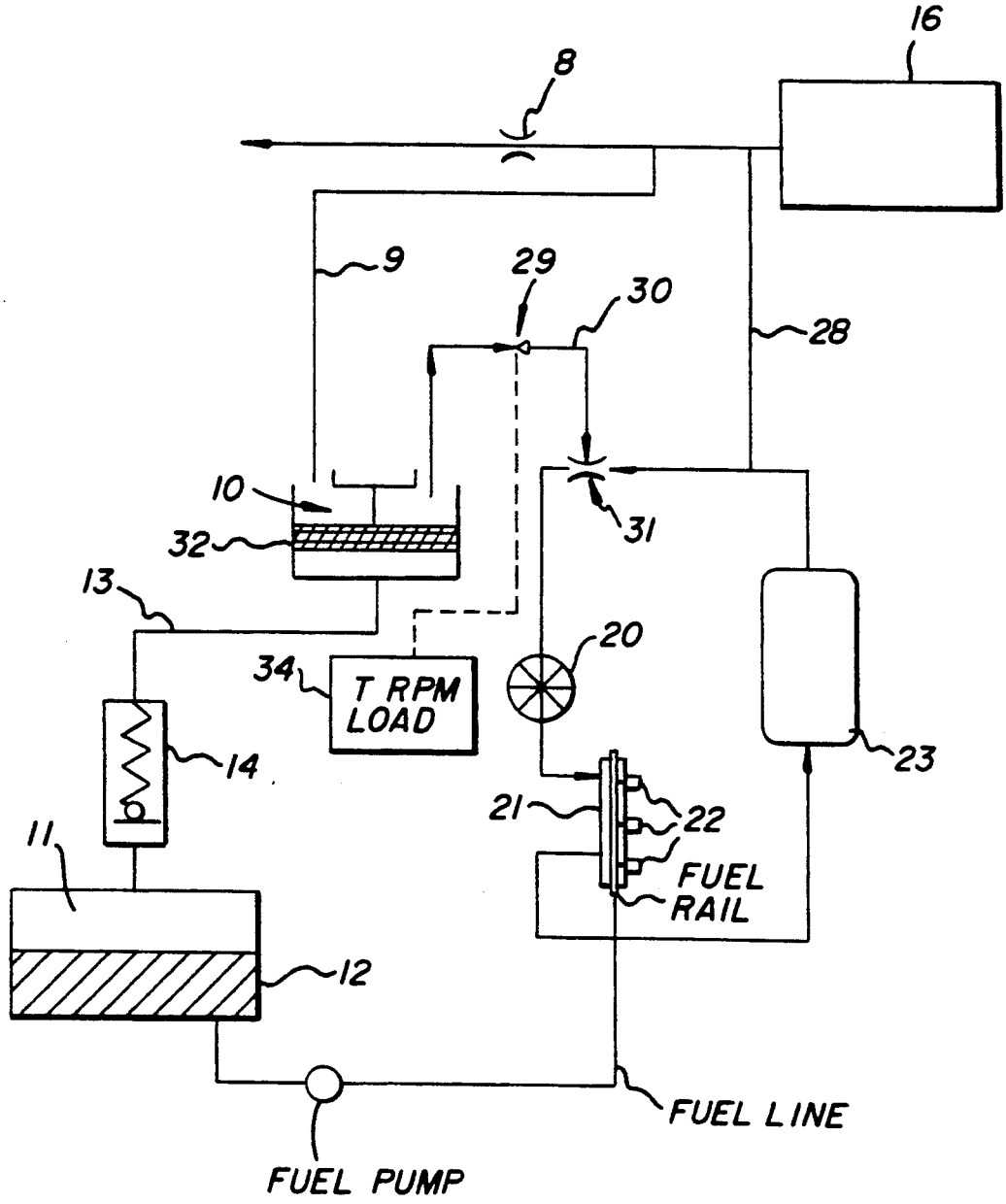
FIG. 3 is a diagrammatic layout of the vapour control and compressed air systems in accordance with an alternative embodiment of the invention.

In FIG. 3 is shown a further embodiment of the invention wherein the conduit 30 communicates the separator 10 with the duct 28 which directly communicates the engine air box 16 with the compressor 20. A control orifice or venturi 31 is provided in the duct 28 at the junction with the duct 30 so that the duct 30 is under the influence of the sub-atmospheric pressure created in the centre of the venturi 31 as the air passes therethrough from the air box 16 to the compressor 20. This arrangement results in the pressure in the duct 30 being substantially directly proportional to the rate of air flow along the duct 28 which is proportional to engine speed. Hence when the compressor is operating, the rate of flow of air with or without fuel vapour from the separator 10 into the duct 28 is substantially proportional to the engine speed. Thus by suitable calibration of the venturi 31 the relation between the rate of air flow from the separator to the compressor and engine speed is determinable.

The location of entry of the fuel free air from the air box 16, and the vapour from the fuel tank 11 to the separator 10 relative to the cnduit 30 through which air is drawn from the separator 10 to the compressor 20 are arranged so the air from both the air box and fuel tank pass through the filter media 32 in the separator 10. This arrangement results in the fuel content of the air passing to the compressor being more uniform. The filter media function somewhat in the manner of an accumulator for fuel entering from the fuel tank which is subsequently released to the air passing to the compressor.

The engine management ECU 34 which includes in its function the determination of the fuel demand of the engine can accordingly be programmed so that in determining the fuel requirement of the engine, the ECU will adjust the metered quantity of fuel delivered through the injector in relation to engine speed, to compensate for the quantity of fuel in vapour form supplied with the compressed air that effects injection of the metered quantity of fuel.

It is to be appreciated that at high fueling rate, such as at high loads and speeds, the amount of fuel supplied from the separator to the compressor is small in relation to the engine fuel demand. Accordingly under such engine operating conditions correction to the fueling rate for the fuel carried in the compressed air may be disregarded. However at idle or other low speed low load conditions, such correction is important in maintaining acceptable emission levels. Also the ECU may be programmed to provide a single correction to the fueling rate for a range of engine speeds as the actual variation of the true correction with that range is small and has an insignificant influence on the engine performance or emission levels.

As part of the engine management system, there is also provided an isolating device 29, which may be in the form of a solenoid operated valve, in the separator duct 30. The solenoid valve is cyclically operated to open and close the separator duct 30. The function of the solenoid valve is to endeavour to obtain under normal operating conditions of the engine, a reasonably steady vapour content in the air being drawn from the separator 10 into the duct 28 leading to the compressor 20. Thus the flow of air from the separator 10 to the compressor is cyclically stopped allowing an accumulation of vapour in the separator which will be purged therefrom when the solenoid is next opened.

It has been found that it is convenient to cycle the solenoid valve on the basis of five seconds open and ten seconds closed.

The engine management ECU 34 is programmed so that when the solenoid opens and air carrying fuel vapour is passing from the cannister to the compressor, the ECU will make an appropriate adjustment to the metered quantity of fuel delivered by the injector to the engine as previously referred to. However, when the solenoid valve is closed, the engine management ECU will not make any correction to the quantity of metered fuel as there is no fuel being provided in the air from the compressor. It is to be understood that the solenoid may also be operated in a manner whereby there are no fixed open and closed periods, but these periods may be modulated by the engine management ECU subject to engine operating conditions.

We claim:

1. A multi cylinder internal combustion engine installation comprising an air compressor 20 to supply air to an injector to effect injection of the fuel for combustion in the engine, a fuel tank 12 wherein fuel for use by the engine is stored, and an air/fuel separator 10 to receive vapour generated in the fuel tank and separate the fuel from the air, characterised by a separator passage 25 communicating that part of the separator 10 wherein the fuel is held with the inlet port of the compressor so that when the compressor 20 is in operation, at least part of the air taken in by the compressor is drawn through the part of the separator 10 where the fuel is held to thereby extract fuel therefrom to be delivered with the compressed air to the injector.

2. An internal combustion engine installation according to claim 1, characterised in that the installation further comprises a fuel rail having a fuel duct through which fuel is continuously circulated, from the fuel tank for supply from the fuel duct to respective fuel injectors.

3. An internal combustion engine installation as claimed in claim 2, characterised by said rail including an air duct that receives air from the compressor for supply to the respective fuel injectors.

4. An internal combustion engine installation according to claim 1, characterised in that control means are provided to control the rate of air flow to the compressor from the air/fuel separator through the separator passage.

5. An internal combustion engine installation according to claim 4 characterised in that the control means are adapted to maintain a substantially fixed ratio between the overall rate of air flow to the compressor and the rate of air flow from the air/fuel separator to the compressor.

6. An internal combustion engine installation according to claim 4, characterised in that the control means are adapted to provide a flow rate of air from the air/fuel separator to the compressor at a substantially steady value over a preselected range of engine load at a selected engine speed.

7. An internal combustion engine installation according to claim 4, characterised in that said control means is adapted to selectively terminate flow through the separator passage to the inlet port of the compressor.

8. An internal combustion engine installation as claimed in claim 1, characterised in that means are provided connecting said inlet port of the compressor to an engine air induction system through which air is supplied to the engine combustion chamber, whereby the compressor can receive air from the induction system and the separator.

9. An internal combustion engine installation as claimed in claim 8, characterised in that the connecting means includes a further passage to convey air from the air induction system to the compressor inlet port, and said separator passage is connected to said further passage intermediate the length thereof, and a venturi is provided in said further passage with the separator passage connected to the throat of the venturi to control the rate of flow of air from the separator into the further passage.

10. An internal combustion engine installation as claimed in claim 9, characterised by the venturi being adapted so the rate of air flow from the separator to the compressor inlet port is a substantially steady value over a preselected range of engine load at a selected engine speed.

11. An internal combustion engine installation as claimed in claim 7, characterised by isolating means to selectively terminate the air flow from the separator to the inlet port of the compressor through the separator passage.

12. An internal combustion engine installation as claimed in claim 11, characterised by said isolating means being adapted to provide an on-off cycle in respect of the connection of the separator passage to the further passage.

13. An internal combustion engine installation as claimed in claim 11, characterised by the said isolating means being adapted to vary the on cycle period in response to selected engine operating conditions.

14. An internal combustion engine installation as claimed in claim 7 including a programmed fuel metering means arranged to determine the engine fuel demand in response to engine operating condition input signals, characterised by said input signals including an engine speed signal and said programmed fuel metering means being arranged to effect a predetermined correction to the engine fuel demand relative to the engine speed in compensation for the rate of fuel flow to the compressor inlet.

15. An internal combustion engine installation as claimed in claim 10 including a programmed fuel metering means arranged to determine the engine fuel demand in response to engine operating condition input signals, characterised by said input signals including an engine speed signal and said programmed fuel metering means being arranged to effect a predetermined correction to the engine fuel demand relative to the engine speed in compensation for the rate of fuel flow to the compressor inlet, and also being characterisd by said input signals including a signal indicating the status of the isolating means, said programmed fuel metering means being arranged to only effect said predetermined correction to the engine fuel demand during the on cycle of the isolating means.

* * * * *